US006879952B2

(12) United States Patent
Acero et al.

(10) Patent No.: US 6,879,952 B2
(45) Date of Patent: Apr. 12, 2005

(54) SOUND SOURCE SEPARATION USING CONVOLUTIONAL MIXING AND A PRIORI SOUND SOURCE KNOWLEDGE

(75) Inventors: Alejandro Acero, Bellevue, WA (US); Steven J. Altschuler, Redmond, WA (US); Lani Fang Wu, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 695 days.

(21) Appl. No.: 09/842,416

(22) Filed: Apr. 25, 2001

(65) Prior Publication Data

US 2001/0037195 A1 Nov. 1, 2001

Related U.S. Application Data

(60) Provisional application No. 60/199,782, filed on Apr. 26, 2000.

(51) Int. Cl.[7] ..... G10L 19/12

(52) U.S. Cl. ..... 704/222; 704/223; 381/94.1; 381/94.2; 381/66; 381/71.1

(58) Field of Search ..... 704/222, 223, 704/217, 219, 246, 264, 242; 381/94.1, 66, 94.2, 71.1; 367/124

(56) References Cited

U.S. PATENT DOCUMENTS

| | | | | |
|---|---|---|---|---|
| 5,026,051 A | | 6/1991 | Lowe et al. | 273/435 |
| 5,052,685 A | | 10/1991 | Lowe et al. | 273/460 |
| 5,138,660 A | | 8/1992 | Lowe et al. | 381/17 |
| 5,208,786 A | * | 5/1993 | Weinstein et al. | 367/124 |
| 5,272,757 A | | 12/1993 | Scofield et al. | 381/25 |
| 5,291,556 A | | 3/1994 | Gale | 381/17 |
| 5,436,975 A | | 7/1995 | Lowe et al. | 381/17 |

(Continued)

OTHER PUBLICATIONS

Gauvain, J.–L.; Chin–Hui Lee, "Maximum a posteriori estimation for multivariate Gaussian mixture observations of Markov chains" Speech and Audio Processing, IEEE Transactions on ,vol.: 2, Issue: 2, Apr. 1994, pp.: 291–298.*

Amari S., Cichocki A. and Yang H.H. "A New Learning Algorithm for Blind Separation". In D.S. Touretzky, M.C. Mozer and M.E. Hasselmo, editors, *Advances in Neural Information Processing Systems*, vol. 8, pp. 757–763. MIT Press, 1996.

H. Attias, "Independent Factor Analysis," *Neural Computation*, vol. 11, no. 4, pp. 803–851, 1999.

H. Attias and C.E. Schreiner, "Blind Source Separation and Deconvolution: The Dynamic Component Analysis Algorithm," *Neural Computation*, vol. 10, pp. 1373–1424, 1998.

(Continued)

*Primary Examiner*—Susan McFadden
*Assistant Examiner*—Huyen X. Vo
(74) *Attorney, Agent, or Firm*—Joseph R. Kelly; Westman, Champlin & Kelly, P.A.

(57) ABSTRACT

Sound source separation, without permutation, using convolutional mixing independent component analysis based on a priori knowledge of the target sound source is disclosed. The target sound source can be a human speaker. The reconstruction filters used in the sound source separation take into account the a priori knowledge of the target sound source, such as an estimate the spectra of the target sound source. The filters may be generally constructed based on a speech recognition system. Matching the words of the dictionary of the speech recognition system to a reconstructed signal indicates whether proper separation has occurred. More specifically, the filters may be constructed based on a vector quantization codebook of vectors representing typical sound source patterns. Matching the vectors of the codebook to a reconstructed signal indicates whether proper separation has occurred. The vectors may be linear prediction vectors, among others.

20 Claims, 11 Drawing Sheets

U.S. PATENT DOCUMENTS

| | | | | | |
|---|---|---|---|---|---|
| 5,448,287 | A | | 9/1995 | Hull | 348/39 |
| 5,473,343 | A | | 12/1995 | Kimmich et al. | 345/145 |
| 5,487,113 | A | | 1/1996 | Mark et al. | 381/17 |
| 5,534,887 | A | | 7/1996 | Bates et al. | 345/120 |
| 5,727,122 | A | * | 3/1998 | Hosoda et al. | 704/223 |
| 5,768,393 | A | | 6/1998 | Mukojima et al. | 381/17 |
| 5,862,229 | A | | 1/1999 | Shimizu | 381/17 |
| 5,867,654 | A | | 2/1999 | Ludwig et al. | 395/200.34 |
| 5,872,566 | A | | 2/1999 | Bates et al. | 304/460 |
| 5,993,318 | A | | 11/1999 | Kousaki | 463/35 |
| 6,040,831 | A | | 3/2000 | Nishida | 345/340 |
| 6,046,722 | A | | 4/2000 | McKiel, Jr. | 345/145 |
| 6,081,266 | A | | 6/2000 | Sciammarella | 345/341 |
| 6,088,031 | A | | 7/2000 | Lee et al. | 345/352 |
| 6,097,390 | A | | 8/2000 | Marks | 345/348 |
| 6,097,393 | A | | 8/2000 | Prouty, IV et al. | 345/419 |
| 6,122,381 | A | | 9/2000 | Winterer | 381/17 |
| 6,185,309 | B1 | * | 2/2001 | Attias | 381/94.1 |
| 6,647,119 | B1 | | 11/2003 | Slezak | 381/17 |

OTHER PUBLICATIONS

M. Brandstein, "Explicit Speech Modeling for Distant–Talker Signal Acquisition," *preprint*, 1998.

M. Brandstein, "On the Use of Explicit Speech Modeling in Microphone Array Applications." In *Proceedings of ICASSP*, pp. 3613–3616, 1998.

M. Brandstein and S. Griebel, "Nonlinear, Model–Based Microphone Array Speech Enhancement." In *Theory and Applications of Acoustic Signal Processing for Telecommunications*, J. Benesty and S. Gay editors, Kluwer Academic Publishers, 2000.

J. Cardoso, "Blind Signal Separation: Statistical Principles." In *Proceedings of the IEEE*, vol. 90, no. 8, pp. 2009–2026, 1998.

J. Cardoso, "Infomax and Maximum Likelihood for Blind Source Separation." In *IEEE Signal Processing Letters*, vol. 4, no. 4, pp. 112–114, 1997.

C. Jutten and J. Herault, "Blind Separation of Sources, Part I : An Adaptive Algorithm Based on Neuromimetic Architecture." In *Signal Processing*, vol. 24, no. 1, pp. 1–10, 1991.

T.W. Lee, "Independent Component Analysis: Theory and Applications," Kluwer Academic Publishers, 210 pages, 1998.

T.W. Lee, M. Girolami and T. Sejnowski, "Independent Component Analysis Using an Extended Infomax Algorithm for Mixed Subgaussian and Supergaussian Sources." In *Nerual Computation*, vol. 11, pp. 417–441, 1999.

B. Perlmutter and L. Parra, "A Context Sensitive Gereralization of ICA." In M. Mozer, M. Jordan & T. Petsche, editors, Advances in Nerual Information Processing, vol. 9, pp. 613–619, Cambridge MA, 1997. MIT Press.

J. Platt and F. Faggin, "Networks for the Separation of Sources that are Superimpsoed and Delayed." In *Proceedings of the Neural Information Processing Systems Conference*, 1991, pp. 730–737, 1991.

E. Weinstein, M. Feder and A. Oppenheim, "Multi–Channel Signal Separation by Decorrelation." In *IEEE Transactions on Speech and Audio Processing*, vol. 1, no. 4, pp. 405–413, 1993.

D. Yellin and E. Weinstein, "Criteria for Multichannel Signal Separation." In *IEEE Transactions on Signal Processing*, vol. 42, no. 8, pp. 2158–2167, 1994.

M. Zibulevsky and B. Pearlmutter, "Blind Source Separation by Sparse Decomposition in a Signal Dictionary." University of New Mexico Technical Report, No. CS99–1, 1999.

* cited by examiner

SOUND SOURCE SEPARATION USING CONVOLUTIONAL MIXING AND A PRIORI SOUND SOURCE KNOWLEDGE

RELATED APPLICATIONS

This application claims the benefit of and priority to the previously filed provisional patent application entitled "Speech/Noise Separation Using Two Microphones and a Model of Speech Signals," filed on Apr. 26, 2000, and assigned Ser. No. 60/199,782.

FIELD OF THE INVENTION

The invention relates generally to sound source separation, and more particularly to sound source separation using a convolutional mixing model.

BACKGROUND OF THE INVENTION

Sound source separation is the process of separating into separate signals two or more sound sources from at least that many number of recorded microphone signals. For example, within a conference room, there may be five different people talking, and five microphones placed around the room to record their conversations. In this instance, sound source separation involves separating the five recorded microphone signals into a signal for each of the speakers. Sound source separation is used in a number of different applications, such as speech recognition. For example, in speech recognition, the speaker's voice is desirably isolated from any background noise or other speakers, so that the speech recognition process uses the cleanest signal possible to determine what the speaker is saying.

The diagram 100 of FIG. 1 shows an example environment in which sound source separation may be used. The voice of the speaker 104 is recorded by a number of differently located microphones 106, 108, 110, and 112. Because the microphones are located at different positions, they will record the voice of the speaker 104 at different times, at different volume levels, and with different amounts of noise. The goal of the sound source separation in this instance is to isolate in a single signal just the voice of the speaker 104 from the recorded microphone signals. Typically, the speaker 104 is modeled as a point source, although it is more diffuse in reality. Furthermore, the microphones 106, 108, 110, and 112 can be said to make up a microphone array. The pickup pattern of FIG. 1 tends to be less selective at lower frequencies.

One approach to sound source separation is to use a microphone array in combination with the response characteristics of each microphone. This approach is referred to as delay-and-sum beamforming. For example, a particular microphone may have the pickup pattern 200 of FIG. 2. The microphone is located at the intersection of the x axis 210 and the y axis 212, which is the origin. The lobes 202, 204, 206, and 208 indicate where the microphone is most sensitive. That is, the lobes indicate where the microphone has the greatest response, or gain. For example, the microphone modeled by the graph 200 has the greatest response where the lobe 202 intersects with the y axis 212 in the negative y direction.

By using the pickup pattern of each microphone, along with the location of each microphone relative to the fixed position of the speaker, delay-and-sum beamforming can be used to separate the speaker's voice as an isolated signal. This is because the incidence angle between each microphone and the speaker can be determined a priori, as well as the relative delay in which the microphones will pick up the speaker's voice, and the degree of attenuation of the speaker's voice when each microphone records it. Together, this information is used to separate the speaker's voice as an isolated signal.

However, the delay-and-sum beamforming approach to sound source separation is useful primarily only in soundproof rooms, and other near-ideal environments where no reverberation is present. Reverberation, or "reverb," is the bouncing of sound waves off surfaces such as walls, tables, windows, and other surfaces. Delay-and-sum beamforming assumes that no reverb is present. Where reverb is present, which is typically the case in most real-world situations where sound source separation is desired, this approach loses its accuracy in a significant manner.

An example of reverb is depicted in the graph 300 of FIG. 3. The graph 300 depicts the sound signals picked up by a microphone over time, as indicated by the time axis 302. The volume axis 304 indicates the relative amplitude of the volume of the signals recorded by the microphone. The original signal is indicated as the signal 306. Two reverberations are shown as a first reverb signal 308, and a second reverb signal 310. The presence of the reverb signals 308 and 310 limits the accuracy of the sound source separation using the delay-and-sum beamforming approach.

Another approach to sound source separation is known as independent component analysis (ICA) in the context of instantaneous mixing. This technique is also referred to as blind source separation (BSS). BSS means that no information regarding the sound sources is known a priori, apart from their assumed mutual statistical independence. In laboratory conditions, ICA in the context of instantaneous mixing achieves signal separation up to a permutation limitation. That is, the approach can separate the sound sources correctly, but cannot identify which output signal is the first sound source, which is the second sound source, and so on. However, BSS also fails in real-world conditions where reverberation is present, since it does not take into account reverb of the sound sources.

Mathematically, ICA for instantaneous mixing assumes that R microphone signals, $y_i[n]$, $y[n]=(y_1[n], y_2[n], \ldots y_R[n])$, are obtained by a linear combination of R sound source signals $x_i[n]$, $x[n]=(x_1[n], x_2[n], \ldots, x_R[n])$. This is written as:

$$y[n]=Vx[n] \tag{1}$$

for all n, where V is the R×R mixing matrix. The mixing is instantaneous in that the microphone signals at any time n depend on the sound source signals at the same time, but at no earlier time. In the absence of any information about the mixing, the BSS problem estimates a separating matrix $W=V^{-1}$ from the recorded microphone signals alone. The sound source signals are recovered by:

$$x[n]=Wy[n]. \tag{2}$$

A criterion is selected to estimate the unmixing matrix W. One solution is to use the probability density function (pdf) of the source signals, $p_x(x[n])$, such that the pdf of the recorded microphone signals is:

$$p_y(y[n])=|W|p_x(Wy[n]). \tag{3}$$

Because the sound source signals are assumed to be independent from themselves over time, x[n+i], i≠0, the joint probability is:

$$e^{\psi} = p_y(y[0], y[1], \ldots, y[N-1]) \quad (4)$$
$$= \prod_{n=1}^{N-1} p_y(y[n]) = |W|^N \prod_{n=0}^{N-1} p_x(Wy[n]).$$

The gradient of Ψ is:

$$\frac{\partial \psi}{\partial W} = (W^T)^{-1} + \frac{1}{N}\sum_{n=1}^{N-1} \phi(Wy[n])(y[n])^T, \quad (5)$$

where φ(x) is:

$$\phi(x) = \frac{\partial \ln p_x(x)}{\partial x}. \quad (6)$$

From equations (4), (5), and (6), a gradient descent solution, known as the infomax rule, can be obtained for W given $p_x(x)$. That is, given the probability density function of the sound source signals, the separating matrix W can be obtained. The density function $p_x(x)$ may be Gaussian, Laplacian, a mixture of Gaussians, or another type of prior, depending on the degree of separation desired. For example, a Laplacian prior or a mixture of Gaussian priors generally yields better separation of the sound source signals from the recorded microphone signals than a Gaussian prior does.

As has been indicated, however, although the ICA approach in the context of instantaneous mixing does achieve sound source signal separation in environments where reverberation is non-existent, the approach is unsatisfactory where reverb is present. Because reverb is present in most real-world situations, therefore, the instantaneous mixing ICA approach is limited in its practicality. An approach that does take into account reverberation is known as convolutional mixing ICA. Convolutional mixing takes into consideration the transfer functions between the sound sources and the microphones created by environmental acoustics. By considering environmental acoustics, convolutional mixing thus takes into account reverberation.

The primary disadvantage to convolutional mixing ICA is that, because it operates in the frequency domain instead of in the time domain, the permutation limitation of ICA occurs on a per-frequency component basis. This means that the reconstructed sound source signals may have frequency components belonging to different sound sources, resulting in incomprehensible reconstructed signals. For example, in the diagram 400 of FIG. 4, the output sound source signal 402 is reconstructed by convolutional mixing ICA from two sound source signals, a first sound source signal 404, and a signal sound source signal 406. Each of the signals 402, 404, and 406 has a frequency spectrum from a low frequency $f_L$ to a high frequency $f^H$. The output signal 402 is meant to reconstruct either the first signal 404 or the second signal 406.

However, in actuality, the first frequency component 408 of the output signal 402 is that of the second signal 406, and the second frequency component 410 of the output signal 402 is that of the first signal 404. That is, rather than the output signal 402 having the first and the second components 412 and 410 of the first signal 404, or the first and the second components 408 and 414 of the second signal 406, it has the first component 408 from the second signal 406, and the second component 410 from the first signal 404. To the human ear, and for applications such as speech recognition, the reconstructed output sound source signal 402 is meaningless.

Mathematically, convolutional mixing ICA is described with respect to two sound sources and two microphones, although the approach can be extended to any number of R sources and microphones. An example environment is shown in the diagram 500 of FIG. 5, in which the voices of a first speaker 502 and a second speaker 504 are recorded by a first microphone 506 and a second microphone 508. The first speaker 502 is represented as the point sound source $x_1[n]$, and the second speaker 502 is represented as the point sound source $x_2[n]$. The first microphone 506 records the microphone signal $y_1[n]$, whereas the second microphone 508 records the microphone signal $y_2[n]$. The input signals $x_1[n]$ and $x_2[n]$ are said to be filtered with filters $g_{ij}[n]$ to generate the microphone signals, where the filters $g_{ij}[n]$ take into account the position of the microphones, room acoustics, and so on. Reconstruction filters $h_{ij}[n]$ are then applied to the microphone signals $y_1[n]$ and $y_2[n]$ to recover the original input signals, as the output signals $\hat{x}_1[n]$ and $\hat{x}_2[n]$.

This model is shown in the diagram 600 of FIG. 6. The voice of the first speaker 502, $x_1[n]$, is affected by environmental and other factors indicated by the filters 602*a* and 602*b*, represented as $g_{11}[n]$ and $g_{12}[n]$. The voice of the second speaker 504, $x_2[n]$, is affected by environmental and other factors indicated by the filters 602*c* and 602*d*, represented as $g_{21}[n]$ and $g_{22}[n]$. The first microphone 506 records a microphone signal $y_1[n]$ equal to $x_1[n]*g_{11}[n]+x_2[n]*g_{21}[n]$, where * represents the convolution operator defined as $$y[n] = x[n] * h[n] = \sum_{m=-\infty}^{\infty} x[m]h[n-m].$$

The second microphone 508 records a microphone signal $y_2[n]$ equal to $x_2[n]*g_{22}[n]+x_1[n]*g_{12}[n]$. The first microphone signal $y_1[n]$ is input into the reconstruction filters 604*a* and 604*b*, represented by $h_{11}[n]$ and $h_{12}[n]$. The second microphone signal $y_2[n]$ is input into the reconstruction filters 604*c* and 604*d*, represented by $h_{21}[n]$ and $h_{22}[n]$. The reconstructed source signal 502' is determined by solving $\hat{x}_1[n]=y_1[n]*h_{11}[n]+y_2[n]*h_{21}[n]$. Similarly, the reconstructed source signal 504' is determined by solving $\hat{x}_2[n]=y_2[n]*h_{22}[n]+y_1[n]*h_{12}[n]$.

The reconstruction filters 604*a*, 604*b*, 604*c*, and 604*d*, or $h_{ij}[n]$, completely recovers the original signals of the speakers 502 and 504, or $x_i[n]$, if and only if their z-transforms are the inverse of the z-transforms of the mixing filters 602*a*, 602*b*, 602*c*, and 602*d*, or $g_{ij}[n]$. Mathematically, this is:

$$\begin{pmatrix} H_{11}(z) & H_{12}(z) \\ H_{21}(z) & H_{22}(z) \end{pmatrix} = \begin{pmatrix} G_{11}(z) & G_{12}(z) \\ G_{21}(z) & G_{22}(z) \end{pmatrix}^{-1} \quad (7)$$
$$= \frac{1}{G_{11}(z)G_{22}(z) - G_{12}(z)G_{21}(z)} \begin{pmatrix} G_{11}(z) & G_{12}(z) \\ G_{21}(z) & G_{22}(z) \end{pmatrix}.$$

The mixing filters 602*a*, 602*b*, 602*c*, and 602*d*, or $g_{ij}[n]$, can be assumed to be finite infinite response (FIR) filters, having a length that depends on environmental and other factors. These factors may include room size, microphone position, wall absorbance, and so on. This means that the reconstruction filters 604*a*, 604*b*, 604*c*, and 604*d*, or $h_{ij}[n]$, have an infinite impulse response. Since using an infinite number of coefficients is impractical, the reconstruction filters are assumed to be FIR filters of length q, which means that the original signals from the speakers 502 and 504, $x_i[n]$, will not be recovered exactly as $\hat{x}_i[n]$. That is, $x_i[n] \neq \hat{x}_i[n]$, but $x_i[n] \approx \hat{x}_i[n]$.

The convolutional mixing ICA approach achieves sound separation by estimating the reconstruction filters $h_{ij}[n]$ from the microphone signals $y_j[n]$ using the infomax rule. Reverberation is accounted for, as well as other arbitrary transfer functions. However, estimation of the reconstruction filters $h_{ij}[n]$ using the infomax rule still represents an less than ideal approach to sound separation, because, as has been mentioned, permutations can occur on a per-frequency component basis in each of the output signals $\hat{x}_i[n]$. Whereas the BSS and instantaneous mixing ICA approaches achieve proper sound separation but cannot take into account reverb, the convolutional mixing infomax ICA approach can take into account reverb but achieves improper sound separation.

For these and other reasons, therefore, there is a need for the present invention.

SUMMARY OF THE INVENTION

This invention uses reconstruction filters that take into account a priori knowledge of the sound source signal desired to be separated from the other sound source signals to achieve separation without permutation when performing convolutional mixing independent component analysis (ICA). For example, the sound source signal desired to be separated from the other sound source signals, referred to as the target sound source signal, may be human speech. In this case, the reconstruction filters may be constructed based on an estimate of the spectra of the target sound source signal. A hidden Markov model (HMM) speech recognition speech can be employed to determine whether a reconstructed signal is properly separated human speech. The reconstructed signal is matched against the words of the dictionary of the speech recognition speech. A high probability match to one of the dictionary's words indicates that the reconstructed signal is properly separated human speech.

Alternatively, a vector quantization (VQ) codebook of vectors may be employed to determine whether a reconstructed signal is properly separated human speech. The vectors may be linear prediction (LPC) vectors or other types of vectors extracted from the input signal. The vectors specifically represent human speech patterns typical of the target sound source signal, and generally represent sound source patterns typical of the target sound source signal. The reconstructed signal is matched against the vectors, or code words, of the codebook. A high probability match to one of the codebook's vectors indicates that the reconstructed signal is properly separated human speech. The VQ codebook approach requires a significantly smaller number of speech patterns than the number of words in the dictionary of a speech recognition system. For example, there may be only sixteen or 256 vectors in the codebook, whereas there may be tens of thousands of words in the dictionary of a speech recognition system.

By employing a priori knowledge of the target sound source signal, the invention overcomes the disadvantages associated with the convolutional mixing infomax ICA approach as found in the prior art. Convolutional mixing ICA according to the invention generates reconstructed signals that are separated, and not merely decorrelated. That is, the invention allows convolutional mixing ICA without permutation, because the a priori knowledge of the target sound source signal ensures that frequency components of the reconstructed signals are not permutated. The a priori knowledge of the target sound source signal itself is encapsulated in the reconstruction filters, and is represented in the words of the speech recognition system's dictionary or the patterns of the VQ codebook. Other advantages, aspects, and embodiments of the invention will become apparent by reading the detailed description, and referring to the accompanying drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, electrical, and other changes may be made without departing from the spirit or scope of the present invention. The following detailed description is, therefore, not to be taken in a limiting sense, and the scope of the present invention is defined only by the appended claims.

General Approach

Figure 7:
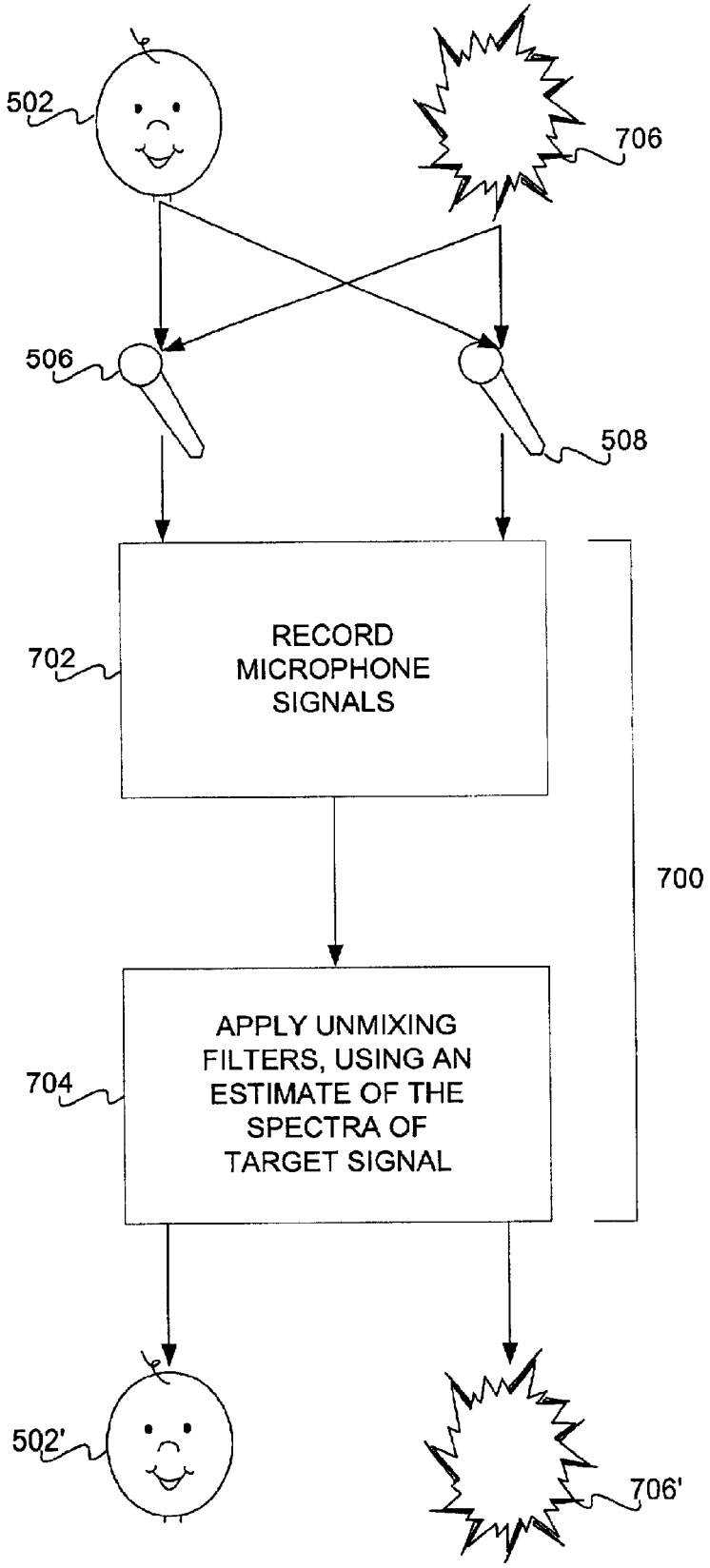
FIG. 7 is a flowchart of a method showing the general approach of the invention to achieve sound source separation.

FIG. 7 shows a flowchart 700 of the general approach followed by the invention to achieve sound source separation. The target sound source is the voice of the speaker 502, which is also referred to as the first sound source. Other sound sources are grouped into a second sound source 706. The second sound source 706 may be the voice of another speaker, such as the speaker 504, music, or other types of sound and noise that are not desired in the output sound source signals. Each of the first sound source 502 and the second sound source 706 are recorded by the microphones 506 and 508. The microphones 506 and 508 are used to produce microphone signals (702). The microphones are referred to generally as sound input devices.

The microphone signals are then subjected to unmixing filters (704) to yield the output sound source signals 502' and 706'. The first output sound source signal 502' is the reconstruction of the first sound source, the voice of the speaker 502. The second output sound source signal 706' is the reconstruction of the second sound source 706. The unmixing filters are applied in 704 according to a convolutional mixing independent component analysis (ICA), which was generally described in the background section. However, the inventive unmixing filters have two differences and advantages. First, it does not need to be assumed that a sound source is independent from itself over time. That is, it exhibits correlation over time. Second, an estimate of the spectrum of the sound source signal that is desired is obtained a priori. This guides decorrelation such that signal separation occurs.

Figure 1:
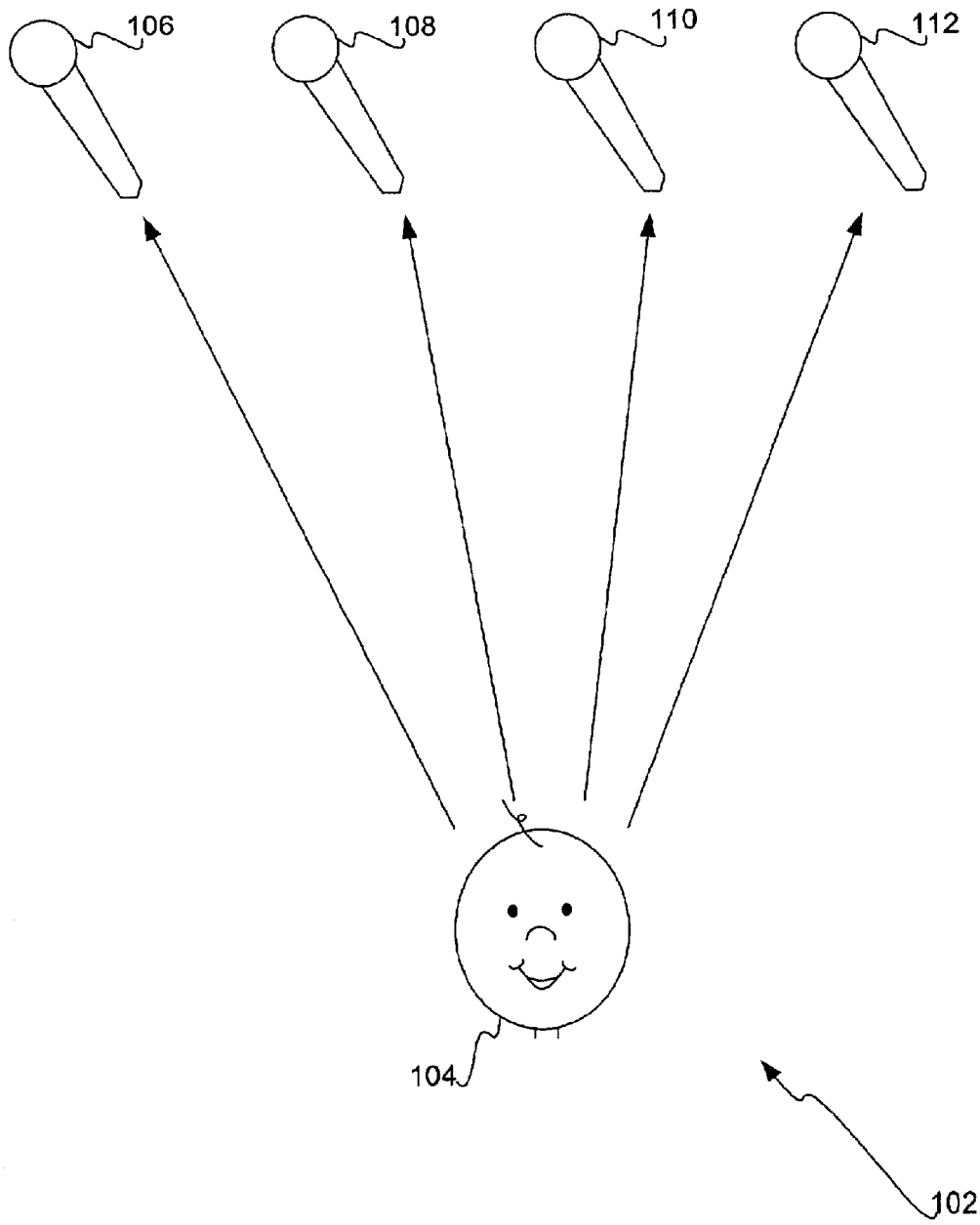
FIG. 1 is a diagram of an example environment in which sound source separation may be used.
Figure 2:
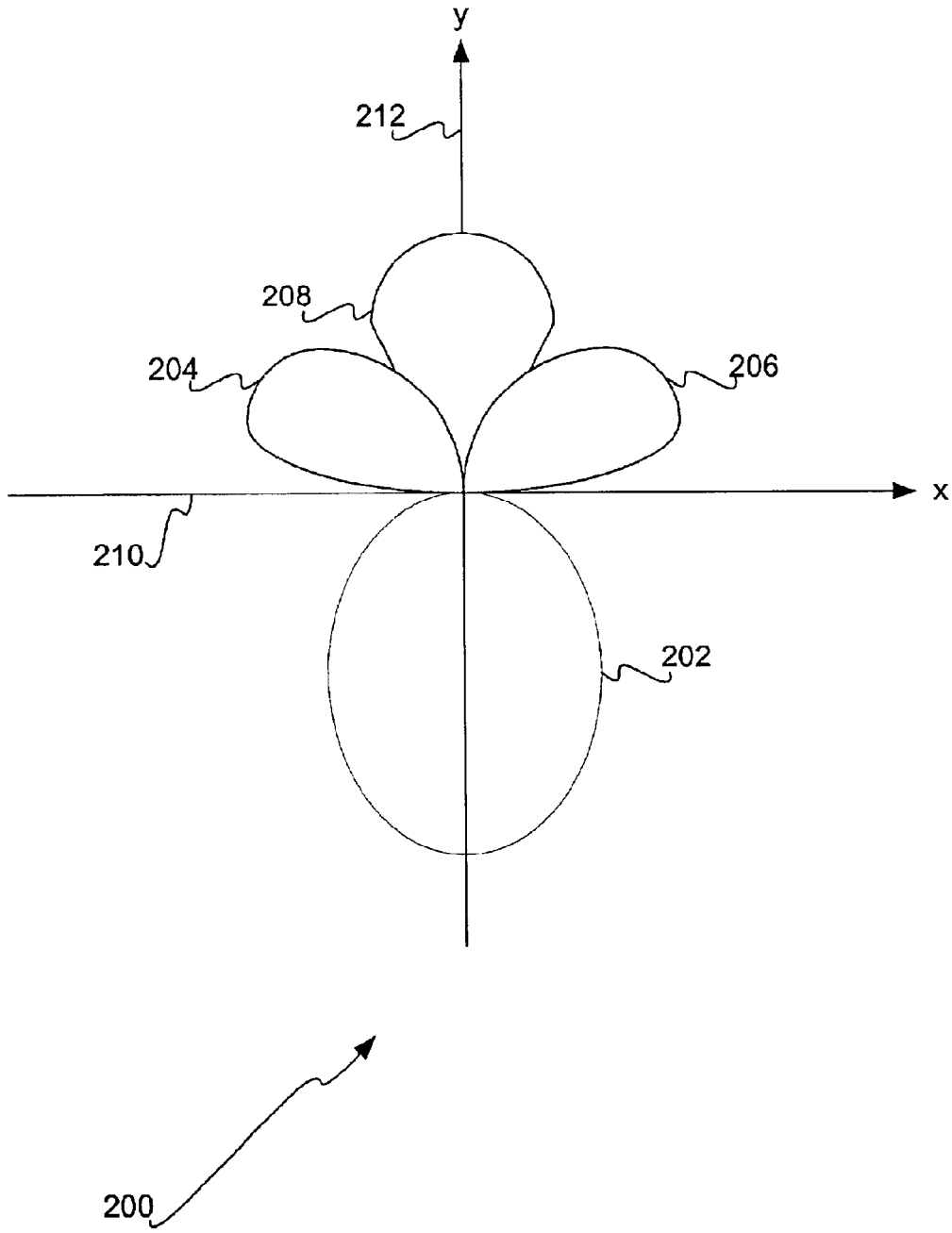
FIG. 2 is a diagram of an example response, or gain, graph of a microphone.
Figure 3:
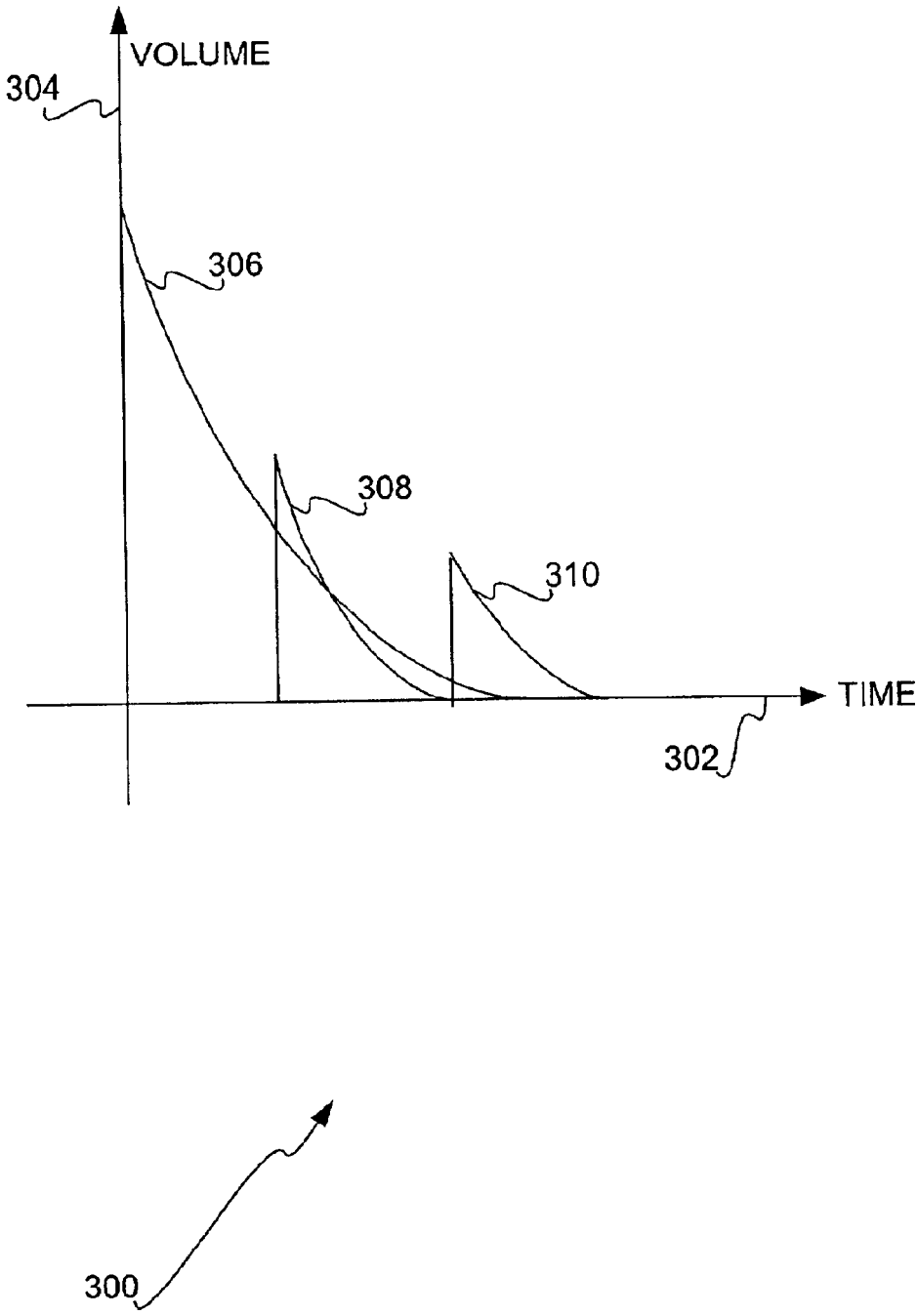
FIG. 3 is a diagram showing an example of reverberation.
Figure 4:
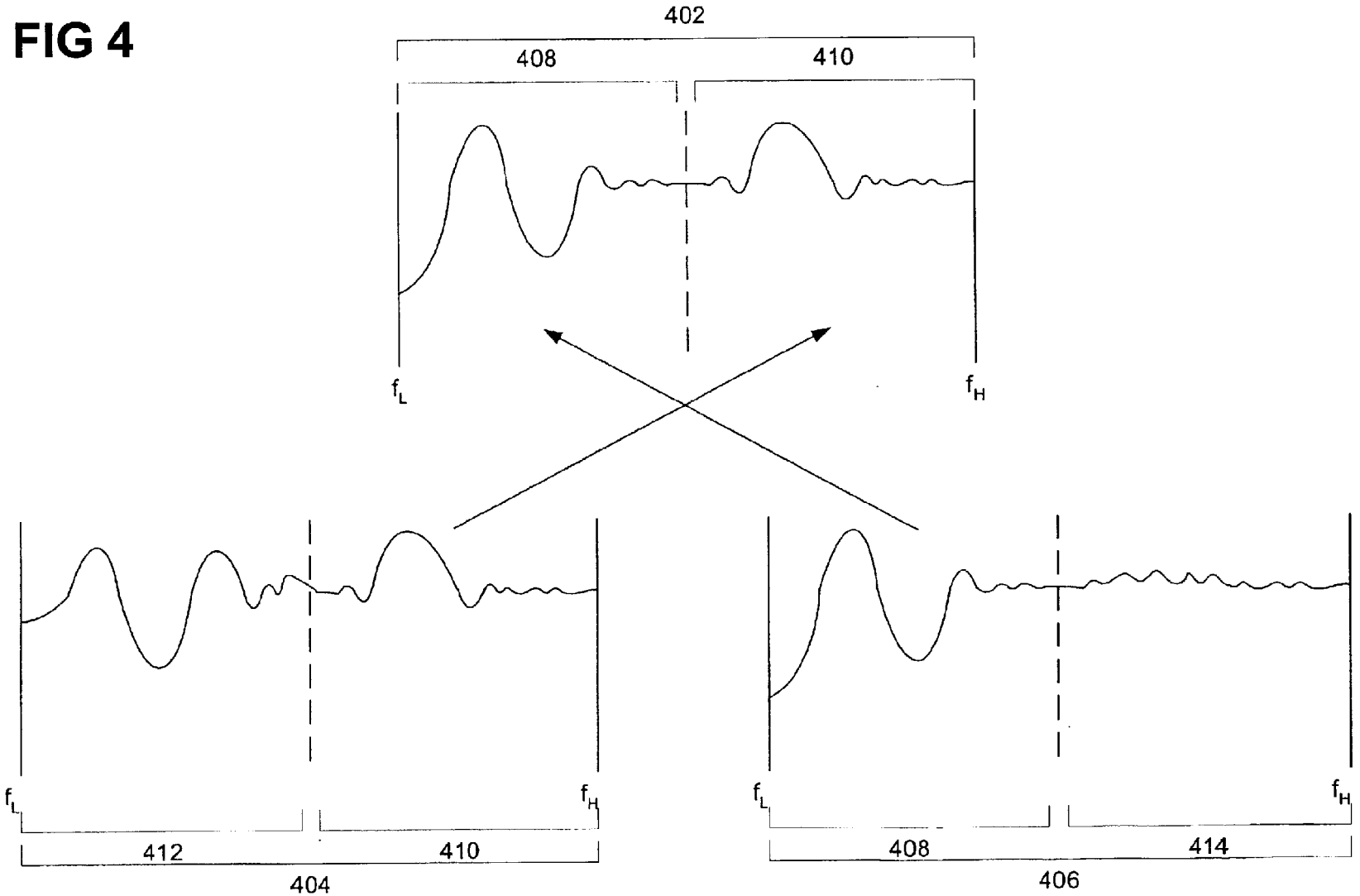
FIG. 4 is a diagram showing how convolutional mixing independent component analysis (ICA) can generate reconstructed signals exhibiting permutation on a per-frequency component basis.
Figure 5:
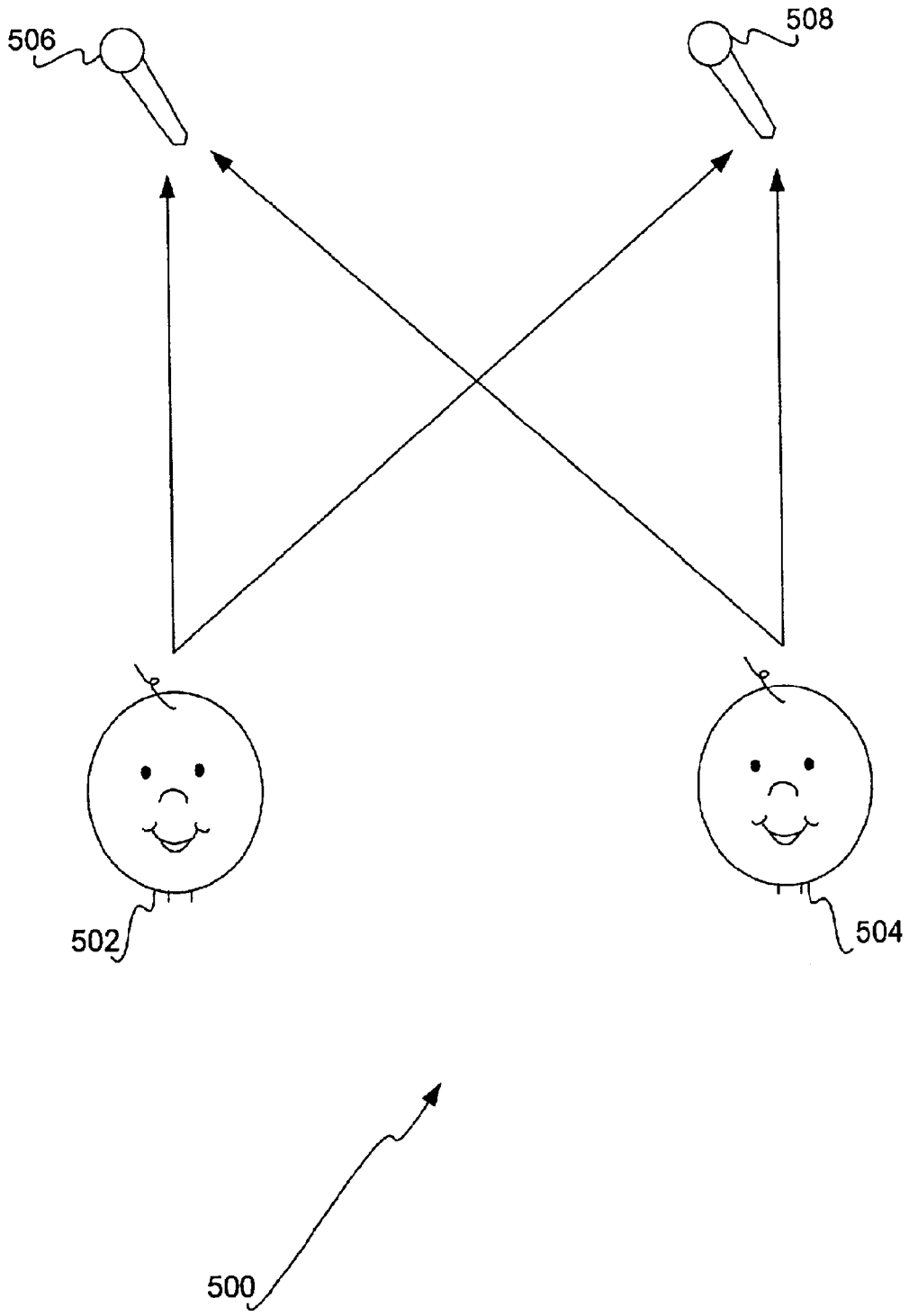
FIG. 5 is a diagram of an example environment in which sound source separation via convolutional mixing ICA can be used.
Figure 6:
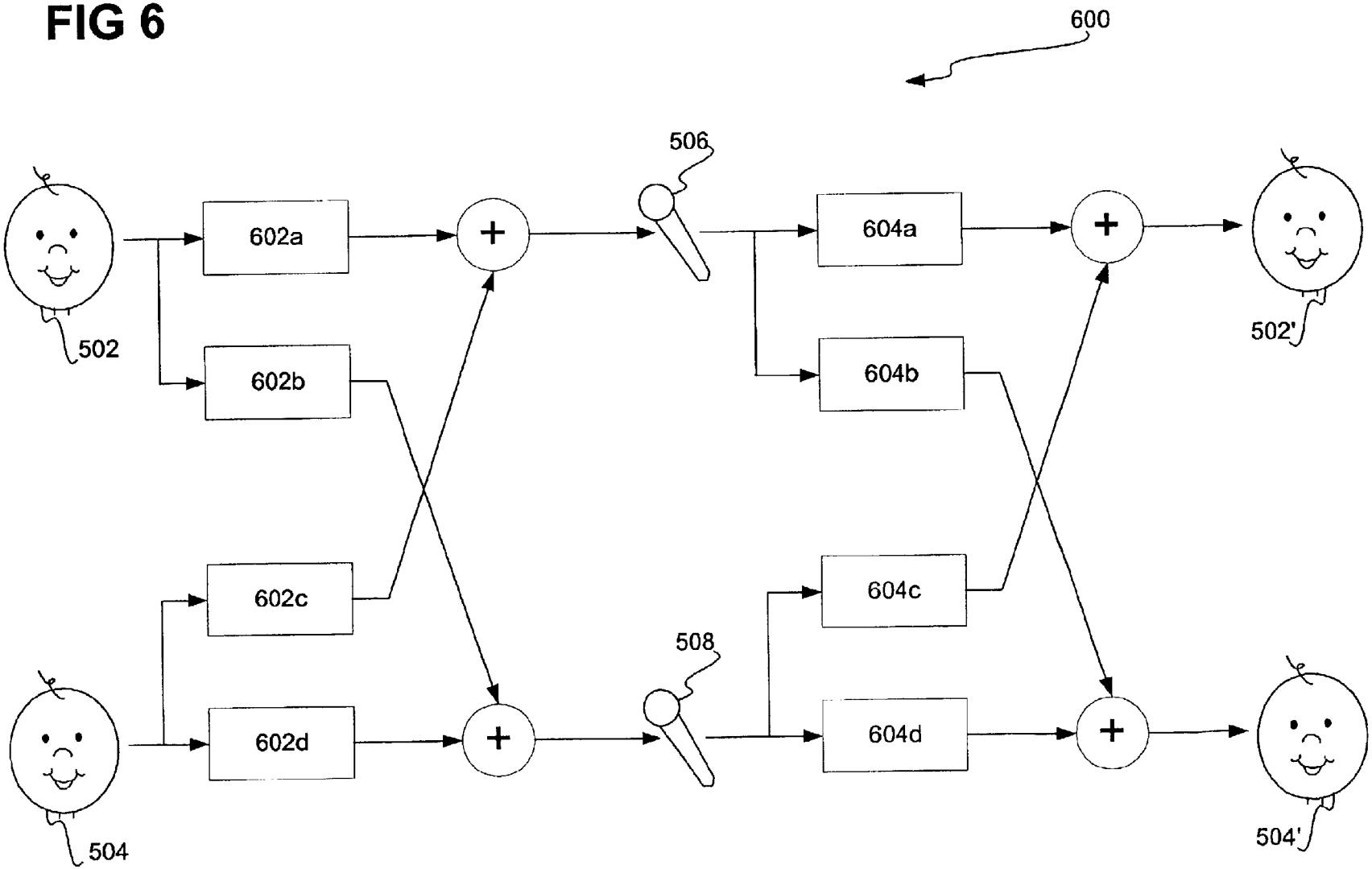
FIG. 6 is a diagram showing an example mode of convolutional mixing ICA.

That is, a priori sound source knowledge allows the convolutional mixing ICA of the invention to reach sound source separation, and not just sound source permutation. The permutation on a per-frequency component basis shown as a disadvantage of convolutional mixing infomax ICA in FIG. 4 is avoided by basing the unmixing filters on an a priori estimate of the spectrum of the sound source signal. The permutation limitation of convolutional mixing infomax ICA is removed, allowing complete separation and decorrelation of the output sound source signals. Otherwise, the inventive approach to convolutional mixing ICA can be the same as that described in the background section, such that, for example, FIGS. 5 and 6 can depict embodiments of the invention.

For example, reverberation and other acoustical factors can be present when recording the microphone signals, without a significant loss of accuracy of the resulting separation. Such factors, generally referred to as acoustical factors, are implicitly depicted in the mixing filters 602*a*, 602*b*, 602*c*, and 602*d* of FIG. 6. Furthermore, the unmixing filters 604*a*, 604*b*, 604*c*, and 604*d* of FIG. 6 also depict the inventive unmixing filters, where the inventive filters have the added limitation that they are based on knowledge of the desired target sound source signal.

The general approach of FIG. 7 shows two input sound sources, with one of the sound sources being a target sound source that is the voice of a human speaker. This is for example purposes only, however. There can be more than two sound sources, so long as there are at least as many microphones as sound sources. Furthermore, the target sound source may be other than the voice of a human speaker, so long as the unmixing filters are based on a priori knowledge of the type of sound source being targeted for separation purposes.

Speech Recognition Approach

To construct separation, or unmixing or reconstruction, filters based on knowledge of the type of sound source being targeted, one embodiment utilizes commonly available speech recognition systems where the target sound source is human speech. A speech recognition system is used to indicate whether a given decorrelated signal is a proper separated signal, or an improper permutated signal. This approach is also referred to as the cepstral approach, in that word matching is accomplished to determine the most likely word to which the decorrelated signal corresponds.

Mathematically, the reconstruction filters are assumed to be finite infinite response (FIR) filters of length q. Although this means that the original sound source signals $x_1[n]$ and $x_2[n]$ will not be exactly recorded, this is not disadvantageous. The target speech signal is represented as $x_1[n]$, whereas the second signal $x_2[n]$ represents all other sound collectively called interference. Without lack of generation, an estimated of the desired output signal $\hat{x}_1[n]$ is:

$$\hat{x}_1[n] = h_1[n] * y_1[n] + h_2[n] * y_2[n] = \sum_{l=0}^{q-1} h_1[l]y_1[n-l] + \sum_{l=0}^{q-1} h_2[l]y_2[n-l]. \tag{8}$$

Using the notation introduced in the background section, $h_{ij}[n]$ represents the reconstruction filters. Where h has only a single subscript, this means that the filter being represented is one of the filters corresponding to the desired output signal. For example, $h_1[n]$ is shorthand for $h_{11}[n]$, where the desired output signal is $\hat{x}_1[n]$. Similarly, $h_2[n]$ is shorthand for $h_{12}[n]$, where the desired output signal is $\hat{x}_1[n]$. The recorded microphone signals are again represented by $y_1[n]$ and $y_2[n]$.

Two vectors are next introduced:

$$h_1=(h_1[\mathbf{0}], h_1[\mathbf{1}], \ldots, h_1[q-1])^T h_2=(h_2[\mathbf{0}], h_2[\mathbf{1}], \ldots, h_2[q-1])^T. \tag{9}$$

The M sample microphone signals for i=1,2 are represented as the vector:

$$y_i=\{y_i[\mathbf{0}], y_i[\mathbf{1}], \ldots, y_i[M-1]\}. \tag{10}$$

A typical speech recognition system finds the word sequence $\hat{W}$ that maximizes the probability given a model $\lambda$ and an input signal s[n]:

$$\hat{W} = \underset{W}{\operatorname{argmax}} p(W \mid \lambda, s[n]). \tag{11}$$

Figure 8:
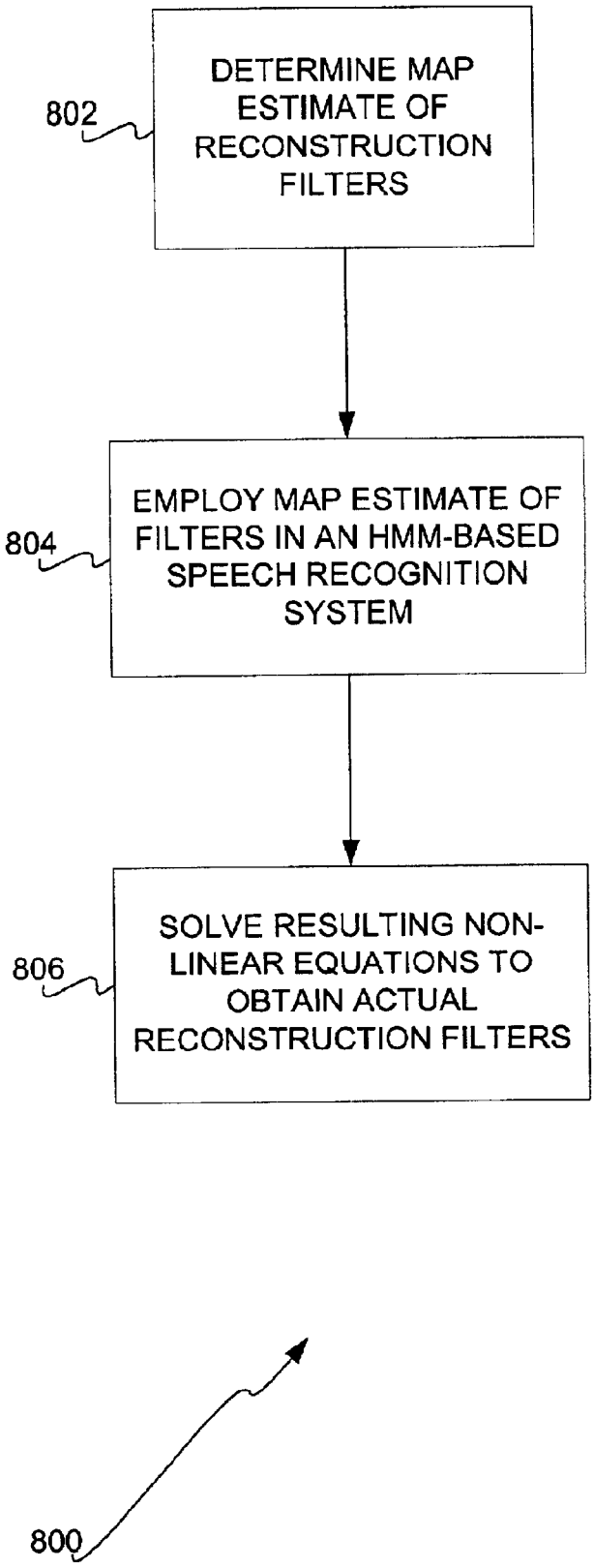
FIG. 8 is a flowchart of a method showing the cepstral approach used by one embodiment to construct the reconstruction filters employed in sound source separation.

The cepstral approach to constructing unmixing filters is depicted in the flowchart 800 of FIG. 8. To accomplish speech recognition of the reconstructed signal $\hat{x}_1[n]=\{\hat{x}_1[\mathbf{0}], \hat{x}_1[\mathbf{1}], \ldots, \hat{x}_1[M-1]\}$, the maximum a posteriori (MAP) estimate is found (802) by summing over all possible word strings W within the dictionary of the speech recognition system, and all possible filters $h_1$ and $h_2$:

$$\begin{aligned} \hat{x} &= \underset{\hat{x}}{\operatorname{argmax}} p(\hat{x} \mid y_1, y_2) \\ &= \underset{\hat{x}}{\operatorname{argmax}} \sum_{W,h_1,h_2} p(\hat{x}, W, h_1, h_2 \mid y_1, y_2) \\ &\approx \underset{\hat{x}}{\operatorname{argmax}} \max_{W} \max_{h_1,h_2} p(y_1, y_2 \mid \hat{x}, h_1, h_2) p(W \mid \hat{x}) p(h_1, h_2). \end{aligned} \tag{12}$$

$\hat{x}$ is shorthand for $\hat{x}_1$, and x is shorthand for $x_1$. Equation (12) uses the known Viterbi approximation, assuming that the sum is dominated by the most likely word string W and the most likely filters. Further, if it is assumed that there is no additive noise, which is the case in FIG. 6, then $p(y_1, y_2|\hat{x}, h_1, h_2)$ is a delta function. Equation (12) thus finds the most likely words in the speech recognition system that matches the microphone signals. As a result, this approach can be referred to as the cepstral approach.

In the absence of prior information for the reconstruction filters, the approximate MAP filter estimates are:

$$(\hat{h}_1, \hat{h}_2) = \underset{h_1, h_2}{\operatorname{argmax}}\left\{\underset{W}{\operatorname{argmax}} p(W \mid \hat{x})\right\}. \tag{13}$$

These filter estimates encapsulate the a priori knowledge of the signal $\hat{x}$, specifically that the input signal is human speech. The MAP filter estimates are then employed within the a standard known hidden Markov model (HMM)-based speech recognition system (804 of FIG. 8). The reconstructed input signal $\hat{x}$ is usually decomposed into T frames $\hat{x}'$ of length N samples each:

$$\hat{x}' = \hat{x}[tN+n], \tag{14}$$

so that the inner term in equation (13) can be expressed as:

$$\underset{W}{\operatorname{argmax}} p(W \mid \hat{x}) = \prod_{t=0}^{T-1} \sum_{k=0}^{K-1} \gamma_t[k] p(k \mid \hat{x}'), \tag{15}$$

where $\gamma_t[k]$ is the a posteriori probability of frame t belonging to Gaussian k, which is one of K Gaussians in the HMM. Large vocabulary systems can often use on the order of 100,000 Gaussians.

The term $p(k|\hat{x}')$ in equation (15), as used in most HMM speech recognition systems, includes what are known as cepstral vectors, resulting in a nonlinear equation, which is solved to obtain the actual reconstruction filters (806 of FIG. 8). This equation may be computationally prohibitive, especially for small devices such as wireless phones and personal digital assistant (PDA) devices that do not have adequate computational power. Therefore, another approach is described next that approximates the cepstral approach and results in a more mathematically tractable solution.

Vector Quantization (VQ) Codebook of Linear Prediction (LPC) Vectors Approach

To construct reconstruction filters based on knowledge of the type of sound source being targeted, a further embodiment approximates the speech recognition approach of the previous section of the detailed description. Rather than the word matching of the previous embodiment's approach, this embodiment focuses on pattern matching. More specifically, rather than determining the probability that a given decorrelated signal is a particular word, this approach determines the probability that a given decorrelated signal is one of a number of speech-type spectra. A codebook of speech-type spectra is used, such as sixteen or 256 different spectra. If there is a high probability that a given decorrelated signal is one of these spectra, then this corresponds to a high probability that the signal is a separated signal.

The approximation of this approach uses an autoregressive (AR) model instead of a cepstral model. A vector quantization (VQ) codebook of linear prediction (LPC) vectors is used to determine the linear prediction (LPC) error of each of the number of speech-type spectra. Because this model is linear in the time domain, it is more computationally tractable than the cepstral approach, and therefore can potentially be used in less computationally powerful devices. Only a small group of different speech-type spectra needs to be stored, instead of an entire speech recognition system vocabulary. The error that is predicted is small for decorrelated signals that correspond to separated signals containing human speech. The VQ codebook of vectors encapsulates a priori knowledge regarding the desired target input signal.

Figure 9:
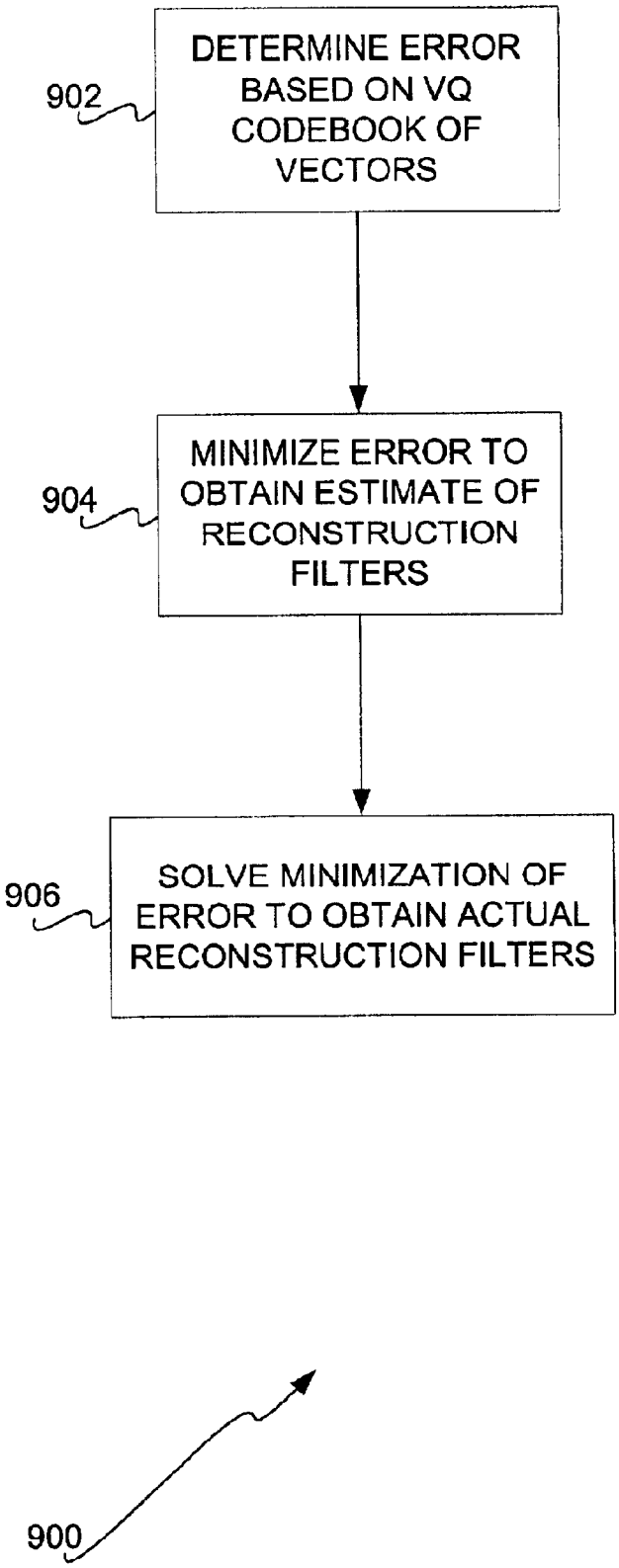
FIG. 9 is a flowchart of a method showing the vector quantization (VQ) codebook approach used by one embodiment to construct the reconstruction filters employed in sound source separation.

The VQ codebook of LPC vectors approach to constructing unmixing filters is depicted in the flowchart 900 of FIG. 9. Mathematically, the LPC error of class k for signal $\hat{x}'[n]$ is first defined (902), as:

$$e_t^k[n] = \sum_{i=0}^{p} a_i^k \hat{x}'[n-i], \tag{16}$$

where i=0, 1, 2, . . . , p, and $\alpha_0^k=1$. The average energy of the prediction error for the frame t is defined as:

$$E_t^k = \frac{1}{N}\sum_{n=0}^{N-1} |e_t^k[n]|^2. \tag{17}$$

The probability for each class can be an exponential density function of the energy of the linear prediction error:

$$p(\hat{x}_t \mid k) = \frac{1}{\sqrt{2\pi}} \exp\left\{-\frac{E_t^k}{2\sigma^2}\right\}. \tag{18}$$

In continuous density HMM systems, a Viterbi search is usually done, so that most $\gamma_t[k]$ of equation (15) are zero, and the rest correspond to the mixture weights of the current state. To decrease computation time, and avoid the search process altogether, the summation in equation (15) can be approximated with the maximum:

$$\begin{aligned}\sum_{k=0}^{K-1} \gamma_t[k] p(k \mid \hat{x}') &\approx \underset{k}{\operatorname{argmax}} \frac{p(\hat{x}' \mid k) p[k]}{p(\hat{x}')} \\ &= \underset{k}{\operatorname{argmax}} p(\hat{x}' \mid k),\end{aligned} \tag{19}$$

where it is assumed that all classes are equally likely:

$$p[k] = \frac{1}{K}, k = 1, 2, \ldots, K. \tag{20}$$

This assumption is based on the insight that only one of the speech-type spectra is likely the most probable, such that the other spectra can be dismissed.

The reconstruction filters are obtained by inserting equation (19) into equations (15) and (13) to achieve minimization of the LPC error to obtain an estimate of the reconstruction filters (904 of FIG. 9):

$$(\hat{h}_1, \hat{h}_2) = \underset{h_1, h_2}{\operatorname{argmin}} \frac{1}{T}\sum_{t=0}^{T-1} \left\{\min_k E_t^k\right\}. \tag{21}$$

The maximization of a negative quantity has been replaced by its minimization, and the constant terms have been ignored. Normalization by T is done for ease of comparison over different frame sizes. The optimal filters minimize the accumulated prediction error with the closest codeword per frame. These filter estimates encapsulate the a priori knowledge of the signal $\hat{x}$, specifically that the input signal is human speech.

Formulae can then be derived to solve the minimization equation (21) to obtain the actual reconstruction filters (906 of FIG. 9). The autocorrelation of $\hat{x}'[n]$ can be obtained by algebraic manipulation of equation (8):

$$\begin{aligned} R^t_{\hat{x}\hat{x}}[i, j] &= \frac{1}{N}\sum_{n=0}^{N-1}\hat{x}'[n-i]\hat{x}'[n-j] \\ &= \sum_{u=0}^{q-1}\sum_{v=0}^{q-1} h_1[u]h_1[v]R^t_{22}[i+u, j+v] + \\ &\quad \sum_{u=0}^{q-1}\sum_{v=0}^{q-1} h_1[u]h_2[v](R^t_{12}[i+u, j+v] + \\ &\quad R^t_{12}[j+u, j+v]) + \\ &\quad \sum_{u=0}^{q-1}\sum_{v=0}^{q-1} h_2[u]h_2[v]R^t_{22}[i+u, j+v], \end{aligned} \tag{22}$$

where the cross-correlation functions have been defined as:

$$R^t_{ij}[u, v] = \frac{1}{N}\sum_{n=0}^{N-1} y^t_i[n-u]y^t_j[n-v]. \tag{23}$$

The autocorrelation of equation (22) has the following symmetry properties:

$$R^t_{ij}[u, v] = R^t_{ji}[v, u]. \tag{24}$$

Inserting equation (16) into equation (17), and using equation (22), $E_t^k$ can be expressed as:

$$\begin{aligned} E^k_t &= \frac{1}{N}\sum_{n=0}^{N-1}\left(\sum_{i=0}^{p} a^k_i\hat{x}'[n-i]\right)\left(\sum_{j=0}^{p} a^k_j\hat{x}'[n-j]\right) \\ &= \sum_{i=0}^{p}\sum_{j=0}^{p} a^k_i a^k_j R^t_{\hat{x}\hat{x}}[i, j] \\ &= \sum_{u=0}^{q-1}\sum_{v=0}^{q-1} h_1[u]h_1[v]\left\{\sum_{i=0}^{p}\sum_{j=0}^{p} a^k_i a^k_j R^t_{11}[i+u, j+v]\right\} + \\ &\quad 2\sum_{u=0}^{q-1}\sum_{v=0}^{q-1} h_1[u]h_2[v]\left\{\sum_{i=0}^{p}\sum_{j=0}^{p} a^k_i a^k_j R^t_{12}[i+u, j+v]\right\} + \\ &\quad \sum_{u=0}^{q-1}\sum_{v=0}^{q-1} h_2[u]h_2[v]\left\{\sum_{i=0}^{p}\sum_{j=0}^{p} a^k_i a^k_j R^t_{11}[i+u, j+v]\right\}. \end{aligned} \tag{25}$$

Inserting equation (25) into equation (21) yields the reconstruction filters. To achieve minimize, an iterative algorithm, such as the known expectation maximization (EM) algorithm. Such an algorithm iterates between find the best codebook indices $\hat{k}_t$ and the best reconstruction filters ($\hat{h}_1[n]$, $\hat{h}_2[n]$).

Figure 10:
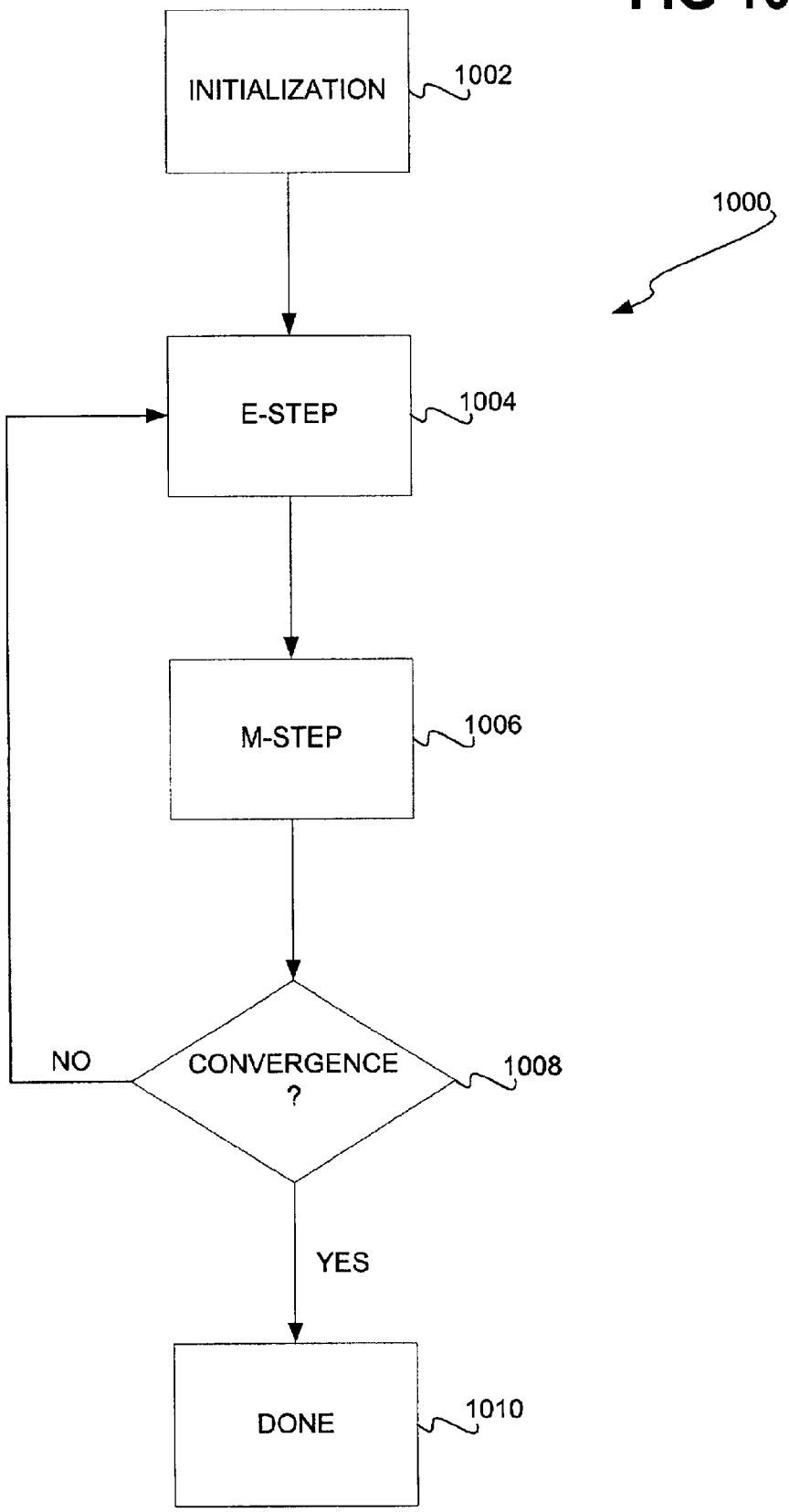
FIG. 10 is a flowchart of a method outlining the expectation maximization (EM) algorithm.

The flowchart 1000 of FIG. 10 outlines the EM algorithm in particular. An initial $h_1[n]$, $h_2[n]$ are started with (1002). In the E-step (1004), for t=0, 1, . . . , T−1, the best codeword is found:

$$\hat{k}_t = \underset{k}{\operatorname{argmin}} E^k_t. \tag{26}$$

In the M-step (1006), the $h_1[n]$, $h_2[n]$ are found that minimize the overall energy error:

$$(\hat{h}_1[n], \hat{h}_2[n]) = \underset{h_1[n], h_2[n]}{\operatorname{argmin}} \frac{1}{T}\sum_{t=0}^{T=1} E^{\hat{k}_1}_t. \tag{27}$$

If convergence is reached (1008), then the algorithm is complete (1010). Otherwise, another iteration is performed (1004, 1006). Iteration continues until convergence is reached.

Alternatively, since equation (25) given $E_t^k$ is quadratic in $h_1[n]$, $h_2[n]$, the optimal reconstruction filters can be obtained by taking the derivative and equating to zero. If all the parameters are free, the trivial solution is $h_1[n]=h_2[n]=0$ $\forall n$, because $\sigma^2$ is not used in equation (18). To avoid this, $h_1[\mathbf{0}]$ is set to one, and solved for the remaining coefficients. This results in the following set of 2 q−1 linear equations:

$$\sum_{u=0}^{q-1} h_1[u]b_{11}[u, v] + \sum_{u=0}^{q-1} h_2[u]b_{21}[u, v] = 0 \quad v = 1, 2, \ldots, q-1 \tag{28}$$

$$\sum_{u=0}^{q-1} h_1[u]b_{21}[u, v] + \sum_{u=0}^{q-1} h_2[u]b_{22}[u, v] = 0 \quad v = 0, 1, \ldots, q-1, \tag{29}$$

where $$\begin{aligned} b_{11}[u, v] &= \sum_{t=t_0}^{T-1}\sum_{i=0}^{p}\sum_{j=0}^{p} a^k_i a^k_j R^t_{11}[i+u, j+v] \\ b_{21}[u, v] &= \sum_{t=t_0}^{T-1}\sum_{i=0}^{p}\sum_{j=0}^{p} a^k_i a^k_j R^t_{12}[i+u, j+v] \\ b_{22}[u, v] &= \sum_{t=t_0}^{T-1}\sum_{i=0}^{p}\sum_{j=0}^{p} a^k_i a^k_j R^t_{22}[i+u, j+v]. \end{aligned} \tag{30}$$

Equations (28) and (29) are easily solved with any commonly available algebra package. It is noted that the time index does not start at zero, but rather at $t_0$, because samples of $y_1[n]$, $y_2[n]$ are not available for n<0.

Code-Excited Linear Prediction (CELP) Vectors Approach

In another embodiment, the VQ codebook of LPC vectors (short-term prediction) of the previous section of the detailed description is enhanced with pitch prediction (long-term prediction), as is done in code-excited linear prediction (CELP). The difference is that the error signal in equation (16) is known to be periodic, or quasi-periodic, so that its value can be predicted by looking at its value in the past.

The CELP approach is depicted by reference again to the flowchart 900 of FIG. 9. The prediction error of equation (17) is again first defined (902), as:

$$E^k_t(g_t, \tau_t) = \frac{1}{N}\sum_{n=0}^{N-1} |e^k_t[n] - g_t e^k_t[n-\tau_t]|^2, \tag{31}$$

where the long-term prediction denoted by pitch period $\tau_t$ can be used to predict the short-term prediction error by using a gain $g_t$. If the speech is perfectly periodic, the gains $g_t$ of equation (31) are one, or substantially close to one. If the speech is at the beginning of a vowel, the gain is greater than one, whereas if it is at the end of a vowel before a silence, the gain is less than one. If the speech is not periodic, the gain should be close to zero.

Using equation (16), equation (31) can be expanded as:

$$E_t^k(g_t, \tau_t) = \sum\sum a_i^k a_j^k \{R_{\tilde{s}\tilde{s}}^t[i, j] - 2g_t R_{\tilde{s}\tilde{s}}^t[i+\tau, j] + g_t^2 R_{\tilde{s}\tilde{s}}^t[i+\tau, j+\tau]\}. \tag{32}$$

An estimate of the optimal reconstruction filters is obtained by minimizing the error (904 of FIG. 9):

$$(\hat{h}_1[n], \hat{h}_2[n]) = \underset{h_1[n], h_2[n]}{\operatorname{argmax}} \frac{1}{T}\sum_{t=0}^{T-1} E_t^{\hat{k}_t}(\hat{g}_t, \hat{\tau}_t), \tag{33}$$

where:

$$E_t^{\hat{k}_t}(\hat{g}_t, \hat{\tau}_t) = \min_{g_t, \tau_t}\min_{k_t} E_t^{k_t}(g_t, \tau_t), \tag{34}$$

and an extra minimization has been introduced over $g_t$ and $\tau_t$. Although the minimization should be done jointly with $k_t$, in practice this results in a combinatorial explosion. Therefore, a different solution is chosen, to solve the minimization to obtain the actual reconstruction filters (906 of FIG. 9). This entails minimization first on $k_t$, and then on $g_t$ and $\tau_t$ jointly, as is often done in CELP coders. The search for $\tau_t$ can be done within a limited temporal range related to the pitch period of speech signals.

The EM algorithm can be used to perform the minimization. Again referring to FIG. 10, an initial $h_1[n]$, $h_2[n]$ are started with (1002). In the E-step (1004), for t=0, 1, . . . , T−1, the best codeword is found:

$$\hat{k}_t = \underset{k}{\operatorname{argmin}} E_t^k. \tag{35}$$

In the M-step (1006), the $h_1[n]$, $h_2[n]$ are found that minimize the overall energy error:

$$(\hat{h}_1[n], \hat{h}_2[n]) = \underset{h_1[n], h_2[n]}{\operatorname{argmin}} \frac{1}{T}\sum_{t=0}^{T=1} E_t^{\hat{k}_t}(\hat{g}_t, \hat{\tau}_t). \tag{36}$$

If convergence is reached (1008), then the algorithm is complete (1010). Otherwise, another iteration is performed (1004, 1006). Iteration continues until convergence is reached.

Joint minimization of equation (35) can be accomplished by using the optimal g for every $\tau$:

$$g_t = \frac{2\sum_{i=0}^{p}\sum_{j=0}^{p} a_i^{\hat{k}_t} a_j^{\hat{k}_t} R_{\tilde{s}\tilde{s}}^t[i+\tau_i, j]}{\sum_{i=0}^{p}\sum_{j=0}^{p} a_i^{\hat{k}_t} a_j^{\hat{k}_t} R_{\tilde{s}\tilde{s}}^t[i+\tau_t, j+\tau]}, \tag{37}$$

and searching for all values of $\tau$ in the allowable pitch range.

Alternatively, solutions of equation (36) given $k_t$, $g_t$, $\tau_t$ can be found by taking the derivative of equation (32) and equation it to zero. This leads to another set of 2 q−1 linear equations, as in equations (28) and (29), but where:

$$b_{11}[u, v] = \sum_{t=t_0}^{T-1}\sum_{i=0}^{p}\sum_{j=0}^{p} a_i^k a_j^k \left\{\begin{array}{l} R_{11}^t[i+u, j+v] - \\ 2g_t R_{11}^t[i+\tau_t+u, j+\tau_t+v] + \\ g_t^2 R_{11}^t[i+\tau_t+u, j+\tau_t+v] \end{array}\right\} \tag{38}$$

$$b_{21}[u, v] = \sum_{t=t_0}^{T-1}\sum_{i=0}^{p}\sum_{j=0}^{p} a_i^k a_j^k \left\{\begin{array}{l} R_{12}^t[i+u, j+v] - \\ 2g_t R_{12}^t[i+\tau_t+u, j+v] + \\ g_t^2 R_{12}^t[i+\tau_t+u, j+\tau_t+v] \end{array}\right\}$$

$$b_{22}[u, v] = \sum_{t=t_0}^{T-1}\sum_{i=0}^{p}\sum_{j=0}^{p} a_i^k a_j^k \left\{\begin{array}{l} R_{22}^t[i+u, j+v] - \\ 2g_t R_{22}^t[i+u, j+v] + \\ g_t^2 R_{22}^t[i+\tau_t+u, j+\tau_t+v] \end{array}\right\}.$$

Example Computerized Device

Figure 11:
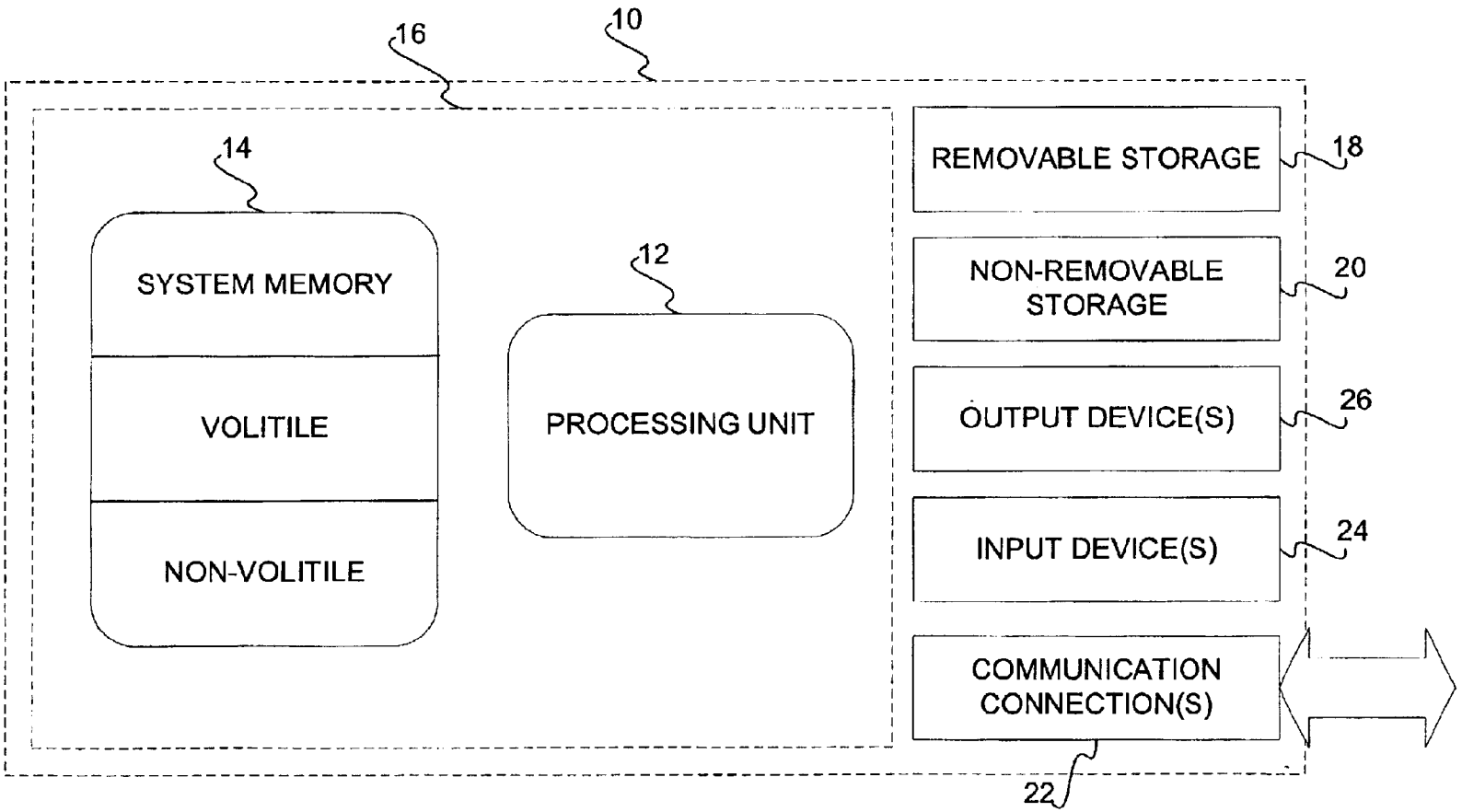
FIG. 11 is a diagram of an example computing device in conjunction with which the invention may be implemented.

FIG. 11 illustrates an example of a suitable computing system environment 10 in which the invention may be implemented. For example, the environment 10 may be the environment in which the inventive sound source separation is performed, and/or the environment in which the inventive unmixing filters are constructed. The computing system environment 10 is only one example of a suitable computing environment and is not intended to suggest any limitation as to the scope of use or functionality of the invention. Neither should the computing environment 10 be interpreted as having any dependency or requirement relating to any one or combination of components illustrated in the exemplary operating environment 10.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems. Additional examples include set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

An exemplary system for implementing the invention includes a computing device, such as computing device 10. In its most basic configuration, computing device 10 typically includes at least one processing unit 12 and memory 14. Depending on the exact configuration and type of computing device, memory 14 may be volatile (such as RAM), non-volatile (such as ROM, flash memory, etc.) or some combination of the two. This most basic configuration is illustrated by dashed line 16. Additionally, device 10 may also have additional features/functionality. For example, device 10 may also include additional storage (removable and/or non-removable) including, but not limited to, magnetic or optical disks or tape. Such additional storage is illustrated in by removable storage 18 and non-removable storage 20.

Computer storage media includes volatile, nonvolatile, removable, and non-removable media implemented in any method or technology for storage of information such as computer readable instructions, data structures, program modules, or other data. Memory 14, removable storage 18, and non-removable storage 20 are all examples of computer storage media. Computer storage media includes, but is not limited to, RAM, ROM, EEPROM, flash memory or other memory technology, CDROM, digital versatile disks (DVD) or other optical storage, magnetic cassettes, magnetic tape, magnetic disk storage or other magnetic storage devices, or any other medium which can be used to store the desired information and which can accessed by device 10. Any such computer storage media may be part of device 10.

Device 10 may also contain communications connection (s) 22 that allow the device to communicate with other devices. Communications connection(s) 22 is an example of communication media. Communication media typically embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Device 10 may also have input device(s) 24 such as keyboard, mouse, pen, sound input device (such as a microphone), touch input device, etc. Output device(s) 26 such as a display, speakers, printer, etc. may also be included. All these devices are well known in the art and need not be discussed at length here.

The approaches that have been described can be computer-implemented methods on the device 10. A computer-implemented method is desirably realized at least in part as one or more programs running on a computer. The programs can be executed from a computer-readable medium such as a memory by a processor of a computer. The programs are desirably storable on a machine-readable medium, such as a floppy disk or a CD-ROM, for distribution and installation and execution on another computer. The program or programs can be a part of a computer system, a computer, or a computerized device.

Conclusion

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. A method comprising:

recording a number of input sound source signals by a number of sound input devices, the number of sound input devices at least equal to the number of input sound source signals, to generete a number of sound input device signals at least equal to the number of input sound source signals, the number of input sound source signals including a target input sound source signal and acoustical factor signals; and, applying a number of reconstruction filters to the number of sound input device signals according to a convolutional mixing independent component analysis (ICA) to generate at least one reconstructed input sound source signal separating the target input sound source signal from the number of sound input device signals without permutation, the number of reconstruction filters taking into account a priori knowledge regarding the target input sound source signal, wherein one of the at least one reconstructed input sound source signal corresponds to the target input sound source signal.

2. The method of claim 1, wherein each of the number of sound input devices is a microphone.

3. The method of claim 1, wherein the target input sound source signals corresponds to human speech.

4. The method of claim 1, wherein the acoustical factor signals include reverberation.

5. The method of claim 1, wherein at least one of the input sound source signals exhibits correlation over time.

6. The method of claim 1, wherein the a priori knowledge regarding the target input sound source signal comprises an estimate of spectra of the target input sound source signal.

7. The method of claim 1, wherein the number of reconstruction filters is constructed based on a speech recognition system, such that the one of the at least one reconstructed input sound source signal corresponding to the target input sound source signal is matched against a plurality of words if a dictionary of the speech recognition system, a high probability match indicating that proper separation has occurred.

8. The method of claim 1, wherein the number of reconstruction filters is constructed based on a vector quantization (VQ) codebook of vectors, the vectors representing sound source patterns typical of the target input sound source signal, such that the one of the at least one reconstructed input sound source signal corresponding to the target input sound source signal is matched against the vectors of the VQ codebook, a high probability match indicating that proper separation has occurred.

9. The method of claim 8, wherein the vectors are linear prediction (LPC) vectors.

10. A machine-readable medium having instructions stored thereon for execution by a processor to perform the method of claim 1.

11. A method for constructing reconstruction filters to separate a target input sound source signal from a number of sound input device signals without permutation according to a convolutional mixing independent component analysis (ICA), comprising:

determining a maximum a posteriori (MAP) estimated number of reconstruction filters by summing over a plurality of possible word strings within a dictionary of a hidden Markov model (HMM) speech recognition system;

employing the MAP estimated number of reconstruction filters within the HMM speech recognition system to generate at least one nonlinear equation representing the number of reconstruction filters; and, solving the at least one nonlinear equation to generate an actual number of reconstruction filters.

12. The method of claim 11, wherein the MAP estimated number of reconstruction filters encapsulates a priori knowledge of the target input sound source signal, where the target sound source signal corresponds to human speech.

13. A machine-readable medium having instructions stored thereon for execution by a processor to perform the method of claim 11.

14. A method for constructing a number of reconstruction filters to separate a target input sound source signal from a number of sound input device signals without permutation according to a convolutional mixing independent component analysis (ICA), comprising:

determining a prediction error based on a vector quantization (VQ) codebook of vectors, the vectors representing sound patterns typical of the target input sound source signal, such that matching the vectors to a reconstructed signal is indicative of whether the reconstructed signal has been properly separated;

minimizing the prediction error to obtain an estimate of the number of reconstruction filters; and, solving the prediction error as minimize to generate the number of reconstruction filters.

15. The method of claim 14, wherein the VQ codebook of vectors encapsulates a priori knowledge of the target input sound source signal as human speech patterns, where the target sound source signal corresponds to human speech.

16. The method of claim 14, wherein the vectors are linear prediction (LPC) vectors, and the prediction error is a linear prediction (LPC) error.

17. The method of claim 14, wherein solving the prediction error as minimized to generate the number of reconstruction filters comprises using an expectation maximization (EM) approach.

18. The method of claim 17, wherein an E-step of the EM approach determines a best codeword within the VQ codebook of vectors.

19. The method of claim 17, wherein an M-step of the EM approach minimizes the prediction error.

20. A machine-readable medium having instructions stored thereon for execution by a processor to perform the method of claim 14.

* * * * *